US011453527B2

(12) United States Patent
Dent

(10) Patent No.: US 11,453,527 B2
(45) Date of Patent: Sep. 27, 2022

(54) HEAVY LOAD CARRIER WITH SWIVEL FLAP

(71) Applicant: Schoeller Allibert GmbH, Schwerin (DE)

(72) Inventor: Matthew Dent, Northwich-Cheshire (GB)

(73) Assignee: Schoeller Allibert GmbH, Schwerin (DE)

( * ) Notice: Subject to any disclaimer, the term of this patent is extended or adjusted under 35 U.S.C. 154(b) by 4 days.

(21) Appl. No.: 16/622,134

(22) PCT Filed: Apr. 18, 2018

(86) PCT No.: PCT/EP2018/059897
§ 371 (c)(1),
(2) Date: Dec. 12, 2019

(87) PCT Pub. No.: WO2018/228742
PCT Pub. Date: Dec. 20, 2018

(65) Prior Publication Data

US 2020/0122885 A1 Apr. 23, 2020

(30) Foreign Application Priority Data

Jun. 14, 2017 (DE) ..... 102017113053.5

(51) Int. Cl.
*B65D 19/18* (2006.01)
*B65D 25/00* (2006.01)

(52) U.S. Cl.
CPC ..... *B65D 19/18* (2013.01); *B65D 25/005* (2013.01); *B65D 2519/00034* (2013.01); *B65D 2519/00069* (2013.01); *B65D 2519/00174* (2013.01); *B65D 2519/00288* (2013.01); *B65D 2519/00338* (2013.01); *B65D 2519/00422* (2013.01)

(58) Field of Classification Search
CPC ..... B65D 19/06; B65D 25/005; B65D 25/06; B65D 2519/00422; B65D 25/00; B65D 19/18; B65D 19/00696
USPC ..... 206/600, 386; 220/6, 4.08
See application file for complete search history.

(56) References Cited

U.S. PATENT DOCUMENTS 4,923,079 A * 5/1990 Foy ..... B65D 19/18 220/326
5,161,709 A * 11/1992 Oestreich, Jr. ..... B65D 25/005 220/4.28
5,199,592 A * 4/1993 Reiland ..... B65D 11/1833 220/817
5,722,555 A 3/1998 Polzl
(Continued)

FOREIGN PATENT DOCUMENTS

DE 2145550 5/1973
DE 2909136 A1 9/1979
(Continued)

OTHER PUBLICATIONS

European Patent Office; International Search Report; dated Jun. 5, 2018.

*Primary Examiner* — Rafael A Ortiz
(74) *Attorney, Agent, or Firm* — Price Heneveld LLP

(57) ABSTRACT

A heavy load carrier includes a base and four peripherally arranged side walls and at least one flap in a side wall, which can be folded outwards, a compulsory guide being provided for a translational movement of the flap when the flap swivels upwards.

14 Claims, 13 Drawing Sheets

(56) References Cited

U.S. PATENT DOCUMENTS

| | | | | |
|---|---|---|---|---|
| 6,820,761 | B1 * | 11/2004 | Mouri | B65D 11/1833 206/600 |
| 8,066,147 | B2 * | 11/2011 | Meers | B65D 25/005 220/682 |
| 8,820,558 | B2 * | 9/2014 | Van der Korput | B65D 19/18 220/1.5 |
| 2004/0200833 | A1 * | 10/2004 | Dubois | B65D 19/18 220/6 |
| 2005/0155967 | A1 * | 7/2005 | Vial | B65D 11/18 220/6 |
| 2006/0260976 | A1 * | 11/2006 | Apps | B65D 19/18 206/600 |
| 2008/0169285 | A1 * | 7/2008 | Marazita | B65D 19/18 220/7 |
| 2009/0134157 | A1 * | 5/2009 | Meers | B65D 11/1893 220/7 |
| 2012/0152799 | A1 * | 6/2012 | Ficker | B65D 19/0028 206/600 |
| 2015/0217902 | A1 * | 8/2015 | Dubois | B65D 19/40 206/600 |
| 2020/0247583 | A1 * | 8/2020 | Sekowski | B65D 11/1833 |

FOREIGN PATENT DOCUMENTS

| | | | | |
|---|---|---|---|---|
| DE | 4342916 | A1 | 9/1994 | |
| DE | 202005012289 | U1 | 10/2005 | |
| DE | 202005009037 | U1 | 8/2006 | |
| DE | 102012220023 | B3 | 12/2013 | |
| EP | 3141492 | A1 | 3/2017 | |
| WO | 2013120439 | A1 | 8/2013 | |
| WO | WO-2013120439 | A1 * | 8/2013 | B65D 25/005 |

* cited by examiner

HEAVY LOAD CARRIER WITH SWIVEL FLAP

BACKGROUND OF THE INVENTION

The invention relates to a heavy load carrier.

The invention relates in particular to heavy load carriers comprising four peripherally arranged side walls, which are arranged swivelably on the base of the heavy load carrier and of which at least one side wall is provided with a flap which can preferably be folded outwards and downwards to clear a flap opening in the side wall.

Within the meaning of the application, heavy load carriers of this type, often also referred to as large containers, are heavy load carriers usually having dimensions in the range of 800×600 mm, 1200×800 mm, 1200×1000 mm and 1200×1600 mm, these being standard dimensions and corresponding deviations between the height and width of the corresponding side walls from the above range being possible in individual cases. Ultimately, the height of heavy load carriers of this type depends on the desired receiving capacity, and so the above specifications are not to be understood as limiting. A conventional height, calculated from the footprint of the heavy load carrier on the ground to the upper edge of the side walls, is 1000 mm, this again not being limiting. However, this gives a definition of the heavy load carrier as distinct from other containers, such as fruit and vegetable containers or bottle crates and the like which can be stacked on top of and alongside one another on pallets in a plurality of layers. The heavy load carriers serve to receive in particular unit products and the like, and are used in the non-food field, in industry, and specifically preferably in the automotive sector. These heavy load carriers are dependent on a construction which is lightweight but still stable in view of the amount of unit products to be received, and also on simple handling when folding up the side walls, if the heavy load carriers are emptied, so as to make simple, compact return transport possible.

Heavy load carriers of this type are configured as reusable containers and in the context of the invention are formed from plastics material. In a vertical position, in which the side walls delimit the transport volume or receiving volume of the heavy load carrier, said side walls are coupled to one another by conventional locking elements, ensuring stable cohesion of the heavy load carrier in the upright position of the side walls.

For easier withdrawal of the products received in the heavy load carrier, the side walls or at least one side wall are provided with a flap which can be folded down outwards, the flap being positioned against the outer face of the corresponding side wall in the folded-down position. Swivel flaps of this type are known (DE 698 26 757 T2), the flap being connected to the side wall via hinges. Alternatively, however, flaps which are displaceable in translation are known (DE 10 2008 047 857 A1), in which the flap can be slid downwards in front of the outer face of the side wall from the position sealing the flap opening in the side wall. Both alternatives could be improved in terms of handling and construction, and this is what is addressed by the invention.

The object of the invention is to create a heavy load carrier which has a flap on at least one side wall, the handling of said flap being improved with a simple construction.

SUMMARY OF THE INVENTION

In accordance with the invention, the flap is articulated to the side wall by means of coupling elements. In this context, the coupling elements are articulated, on the one hand, to the side wall itself by means of side wall joints and, on the other hand, to the flap by means of flap joints, in such a way that the swivel connection between the flap and the side wall is established by interposing these coupling elements, facilitating handling when the flap is opened and closed.

Moreover, according to the invention, at least one compulsory guide for the flap is provided in such a way that, during the swivelling of the flap by means of the coupling elements, said guide simultaneously brings about a translational flap movement, specifically advantageously in the plane of the flap itself, causing the flap to move upwards in the direction of the upper edge, and thus up the side wall, as a result of the compulsory guide during the closing of the flap opening.

In an advantageous embodiment of the invention, the positive guide of the flap is formed for a translational flap movement by means of at least one leading ramp, which is arranged on the side wall in the region of the flap opening or of the flap.

Expediently, the flap, the coupling element or the side wall has at least one guide groove, which is provided for the translational flap movement and cooperates with one of the two joints of the coupling element, in other words either with the joint which articulates the coupling member to the flap or with the joint which articulates the coupling member to the side wall.

The advantage of the provision according to the invention is that when the flap is folded or swivelled up, so as to bring it into the closed position in which it seals the flap opening in the side wall, a lifting movement is brought about, in effect automatically, and makes it possible for a locking element formed on the flap to be engageable in a complementary locking element on the side wall so as to lock the flap in the closed position. As a result of the compulsory guide, this takes place automatically when the flap is folded up, and as a result the flap undergoes a lifting movement in the direction of the upper edge of the side wall, and thus during the engagement in the locking position a corresponding locking element is engaged behind at the side wall and the flap is thus lockable with respect to the side wall. For opening, the flap merely needs to be lifted, and then immediately be folded downwards again. This very significantly simplifies the handling of heavy load carriers of this type when the product is loaded and unloaded.

In an expedient development of the invention, the compulsory guide is arranged on each of the two side edges of the flap opening and the two edges of the flap. This results in reliable opening and closing of the flap, since the flap is in effect guided without tilting during the closing process.

In an advantageously simple configuration, in each case a first leading ramp is provided on the side edges of the flap opening of the side wall, and cooperates in each case with a first projection on the two side flap edges, which is preferably formed hooked. This brings about a simple compulsory guidance, since only one leading ramp has to be provided, and can immediately be configured at the side edges of the flap opening and makes the lifting movement possible in a simple manner. Naturally, the reverse arrangement is also possible, in other words the reverse arrangement of the leading ramp and the projections which cooperate therewith on the flap or on the side edges of the flap opening.

In a further advantageous embodiment of the invention, which is highly advantageous in particular for narrow side walls, in each case a second leading ramp is provided on the side edges of the flap opening or on the side edges of the flap, in a manner corresponding to a projection that cooperates with said ramp. In this case, the first and the second leading ramp cooperate in that when the flap runs up the first leading ramp and is located at the upper end of the ramp, if the flap is further closed into the closing position the corresponding second projection runs up the second leading ramp and thus in effect it is made possible virtually to double the lifting movement with a simple construction. A kinematically reversed arrangement of the ramp and the projection is correspondingly possible.

If there are second ramps, it is expedient to arrange them offset upwards in the direction of the upper edge of the side wall with respect to the first leading ramp and the projection cooperating therewith.

In a particularly expedient development of the invention, the ramps are formed in such a way that the flaps fall down, either under gravity or under a suitable spring bias, as soon as the ramps are passed over. This applies both in embodiments with one compulsory guide and in embodiments with two compulsory guides, which in this case are preferably each formed by oblique ramps.

Since the projections cooperating with the ramp faces are formed as locking elements, specifically preferably by hooked projections, the lowering of the flap after passing over the ramp results in automatic locking of the flaps in the closed position, in that the in particular hooked projections engage behind the ramps. In this context, it is expedient to use the ramps as locking elements, it also being possible, in an expedient configuration, for the ramps to be provided with an undercut in the form of grooves for the locking engagement if required.

In connection with the ramp-like configuration or the compulsory guide, it is expedient to provide springs which are biased when the flap is closed, it being possible for the closed position to be secured or for the swivelling of the flap out into the opening position to be facilitated, depending on the orientation of the biasing force by way of a corresponding configuration and/or arrangement of the springs.

The coupling elements and the joints of the coupling elements may be configured in a very simple manner, since expediently two pivot bolts are provided for the articulated linkage, which preferably each engage through the coupling element, one of the pivot bolts being displaced on the flap and the other pivot bolt being displaced on the side wall. A flush arrangement can be achieved in that the coupling elements are each received in recesses on the flap edge which is lower in the closed position of the flap. In this connection, it is expedient to provide the guide for the flap, in other words the translational guide, in the form of grooves in the side faces of the recesses, with which the corresponding joint or the pivot bolt of the coupling element cooperates. If required, the translational guide can also correspondingly be provided in the coupling member itself or on the side wall.

It is advantageous to provide a stop tongue on the inside of the flap, in such a way that compulsory coupling of the flap to the coupling element or elements can be ensured. This has the advantage that when the flap is swivelled up it cannot be overswivelled, but rather the flap remains aligned with the coupling element during the upper swivel movement.

As was stated previously above, the ramp may be formed in different positions in particular of the side wall in the region of the flap opening. In particular, but not exclusively, in connection with heavy load carriers which can be provided with a lid for sealing the end-face opening of the heavy load carrier, it is advantageous to displace the latching of the flap in the closed position downwards from the upper end region of the side wall of the heavy load carrier in the direction of the lower edge of the flap opening. This is incidentally also advantageous in connection with the ramp for introducing the translational flap movement when the flap is closed. In the context of the invention, it is thus expedient to arrange or form the locking or latching on the lower flap edge, especially on both longitudinal faces of the flap, in a corresponding configuration. An arrangement of this type is also highly advantageous for the ramp, in particular in connection with the displacement of the latching into a lower region of the flap.

Finally, in the context of the invention it is advantageous for at least one downwardly directed extension, which delimits a receiving pocket in which an upwardly directed wall projection of said wall is formed in the region of the flap opening in the closed position, to be formed in particular on the lower flap edge on the outwardly directed face. This results in a latching in the closed position of the flap, in which the flap is orientated vertically and at the same time the wall projection dips into the receiving pocket of the flap. In this context, when the flap is folded downwards, in particular at the start of the flap movement, the wall projection can form a guide for the flap movement of the flap. In this context, it may be expedient to form the extension and the wall projection, and thus the receiving pocket, as well as the ramp, on the lower edge of the flap opening or in the region of the lower edge of the flap opening.

When an in particular tongue-shaped extension of this type is implemented on the flap, in connection with general encompassing coupling members a translational flap movement can be prevented in a folded-down position of the flap; instead, to close the flap opening, the flap first has to be swivelled upwards from its lowest flap position, and only when this blocking barrier is eliminated does a translational adjustment of the flap in the direction of the upper side wall edge take place in the further region of the flap movement.

Advantageously, the flap may be provided with a handle, for example a pivot handle, or with a handle opening.

BRIEF DESCRIPTION OF THE DRAWINGS

Hereinafter, embodiments of the invention are described purely schematically with reference to the drawings, in which.

DETAILED DESCRIPTION OF THE PREFERRED EMBODIMENTS

Figure 1:
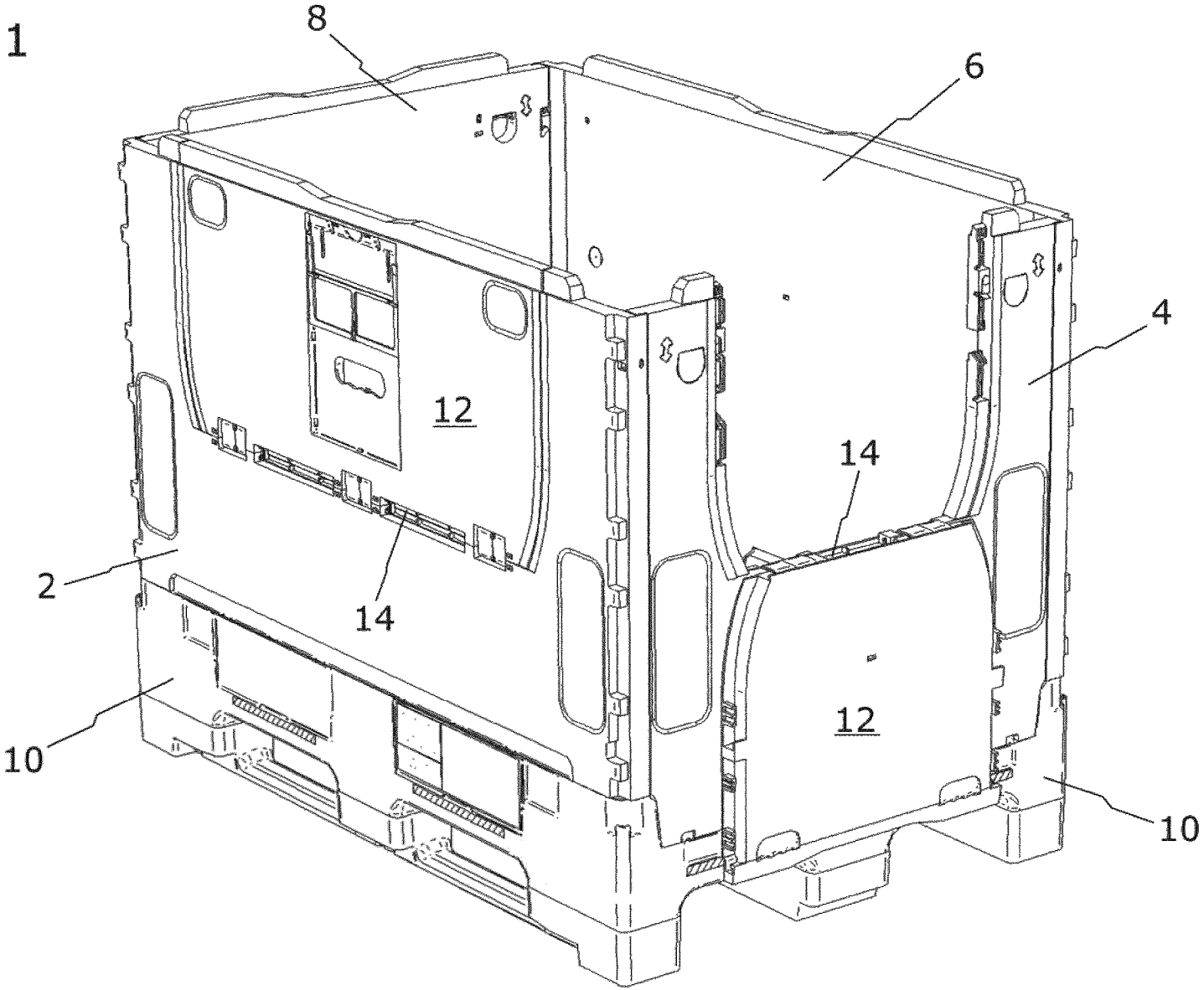
FIG. 1 is a perspective view of a heavy load carrier.

FIG. 1 shows a heavy load carrier according to the invention, which has four peripherally arranged side walls 2, 4, 6 and 8, the side walls being foldably articulated on a base 10, and at least one side wall having a closing flap 12 which is articulated by the lower slap edge 14 thereof to the corresponding side wall.

The base has conventional support feet, which between them delimit engagement openings for lifting devices, such as prongs of forklift trucks. In this case, the heavy load carrier is made from plastics material.

Figure 2:
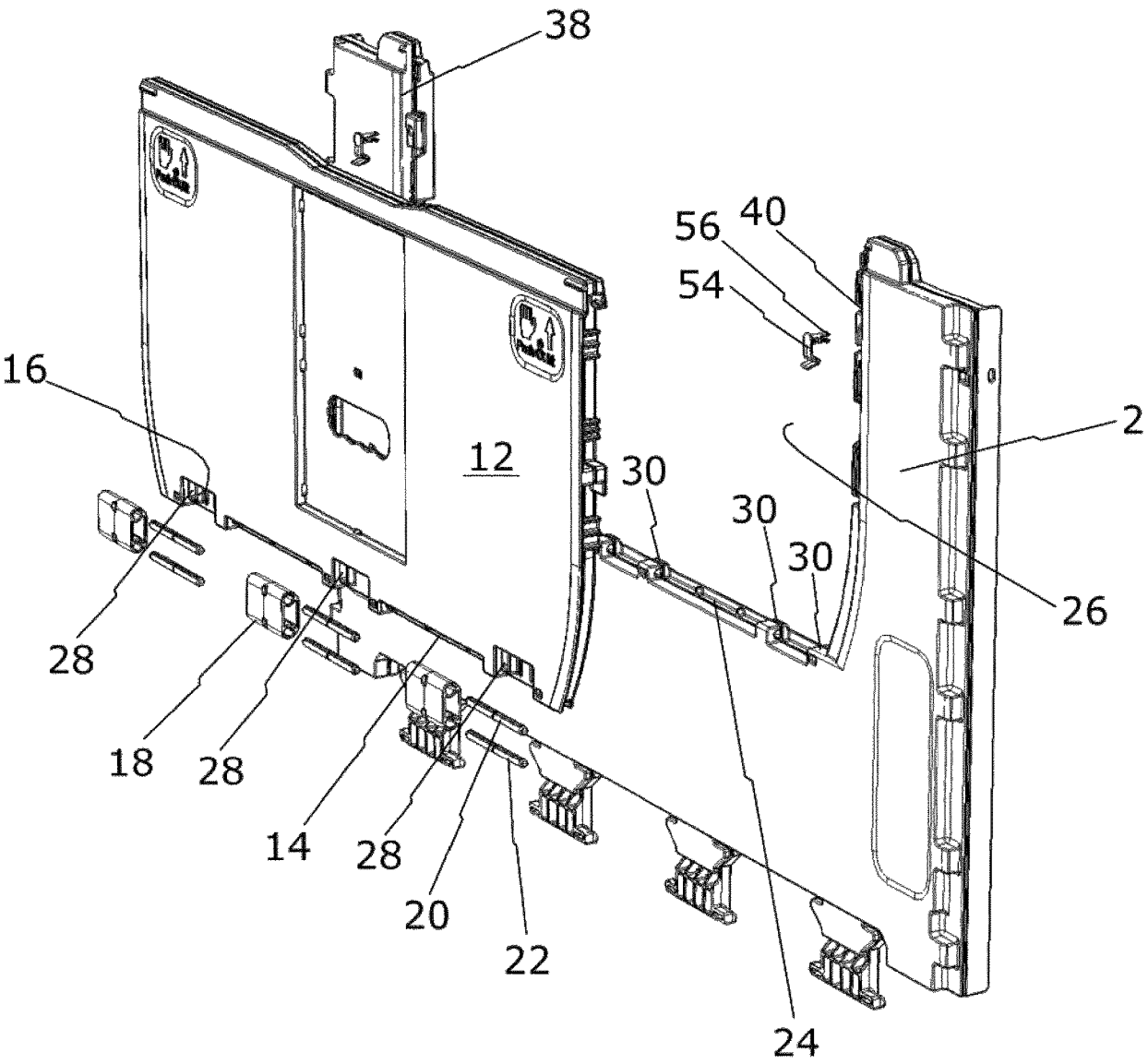
FIG. 2 is a perspective view of one of the side walls of the heavy load carrier of FIG. 1, which is equipped with a swivel flap having a modification according to the invention.

FIG. 2 is an exploded view of the side wall 2 along with further elements. Purely by way of example, but in a non-limiting manner, the flap has at the lower flap edge 14 three recesses 16, which are in turn for receiving three coupling elements 18. In this context, the flap 12 is articulated to the (in a non-limiting manner) three coupling elements 18, specifically by means of pivot bolts 20, in such a way that three flap joints are formed in total in that the pivot bolts 20 engage through the coupling elements 18 and the ends of said bolts are also respectively displaced into the flap recesses 16 which receive the coupling elements 18.

At the opposite end, the coupling elements 18 are in turn connected, preferably via pivot bolts 22, to the lower edge 24 of the flap opening 26, for which purpose, again purely by way of example, according to FIG. 2 corresponding extensions 30, into which the ends of the pivot bolts 22 are displaced, are formed on the lower edge 24 of the flap opening 26.

As a result, the flap 12 is articulated to the side wall 2 via the coupling elements 18, specifically to the corresponding coupling element via a flap joint and, using the threaded bolt 22, to the side wall via the associated coupling element. The interposition of the coupling members, which connect the flap 12 to the side wall via two joints, results in simplified swivelling of the flap relative to the associated side wall.

Figure 3:
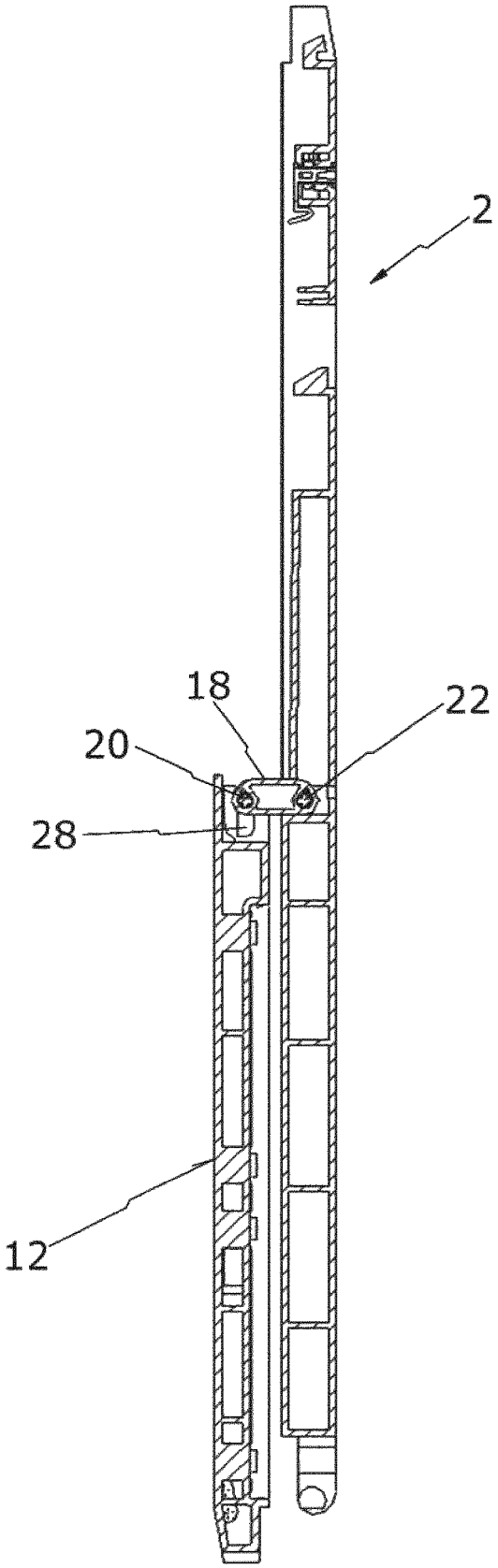
FIG. 3 is a purely schematic sectional view through the side wall of FIG. 2 at the level of the flap opening in the side wall, which like the following drawings only shows the elements which are of significance for explaining the operation and construction of the invention.

FIG. 3 is a purely schematic sectional view through the side wall 2 in the region of the flap opening 26, the flap 12 being located in the folded-down position, in which the flap opening 26 is fully open. In this context, in the drawing of FIG. 3, the coupling element 18 shown in the drawing is located in the horizontal position, in other words perpendicular to the plane of the side wall 2, although this again is not obligatory. In this context, in this swivelled-down flap position, the flap 12 is substantially parallel to the side wall 2.

Expediently, the pivot bolt 20 of the flap joint is received in translation in a guide groove 28 of the flap. In this context, FIG. 3 merely shows one coupling element in each case and also merely one guide groove, but expediently the guide grooves 28 are formed on both side edges of the recesses 16 which respectively receive the coupling elements 18, this being shown schematically on the left side of the recess 16 in each case in FIG. 2. The guide groove 28 expediently extends in the plane of the side wall 12, and makes possible a translational movement of the flap 12 relative to the pivot bolt 20. In the embodiment shown, the other pivot bolt 22 of the swivel flap joint is mounted in an articulated manner, in other words swivelably but not displaceably in translation, in the extensions 30, in corresponding openings on the lower edge 24 of the opening 26. Alternatively, for example the coupling element could also be provided with a corresponding guide groove in each case, in which case the pivot bolt 20 could then move in translation in the coupling element. Alternatively, corresponding guide grooves would also be possible merely in the extensions. However, the configuration shown in the drawings is preferred, in which the guide grooves for the translational movement of the flap 12 are formed on the flap side.

Figure 4:
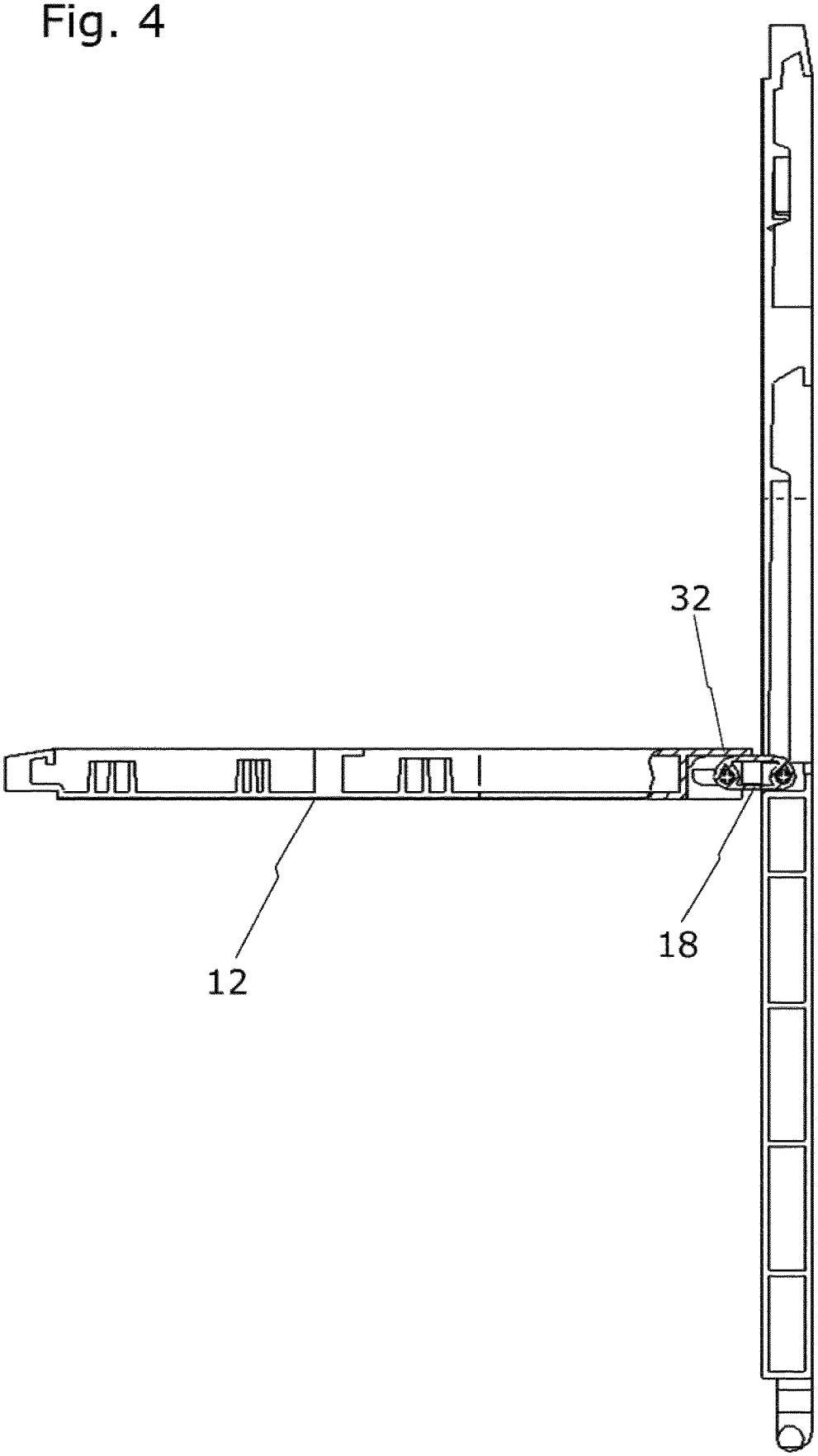
FIGS. 4 to 9 are corresponding views analogous to FIG. 3 which show the flap in various swivel positions during swivelling up into the closed position.

FIG. 4 shows the flap after swivelling up through approximately 90°, the flap in this case being located in the horizontal direction, in other words perpendicular to the plane of the side wall 2. In an expedient configuration, stop tongues 32 formed on the flap inner face encompass the coupling elements on the inner face of the flap 12 in this context, as can be seen from FIG. 4. As a result, overswivelling of the flap joint is prevented when the flap swivels up, and instead, when the flap 12 continues to swivel up from the position shown in FIG. 4, the flap 12 is entrained with the coupling element 18 in the position shown in FIG. 4.

Figure 5:
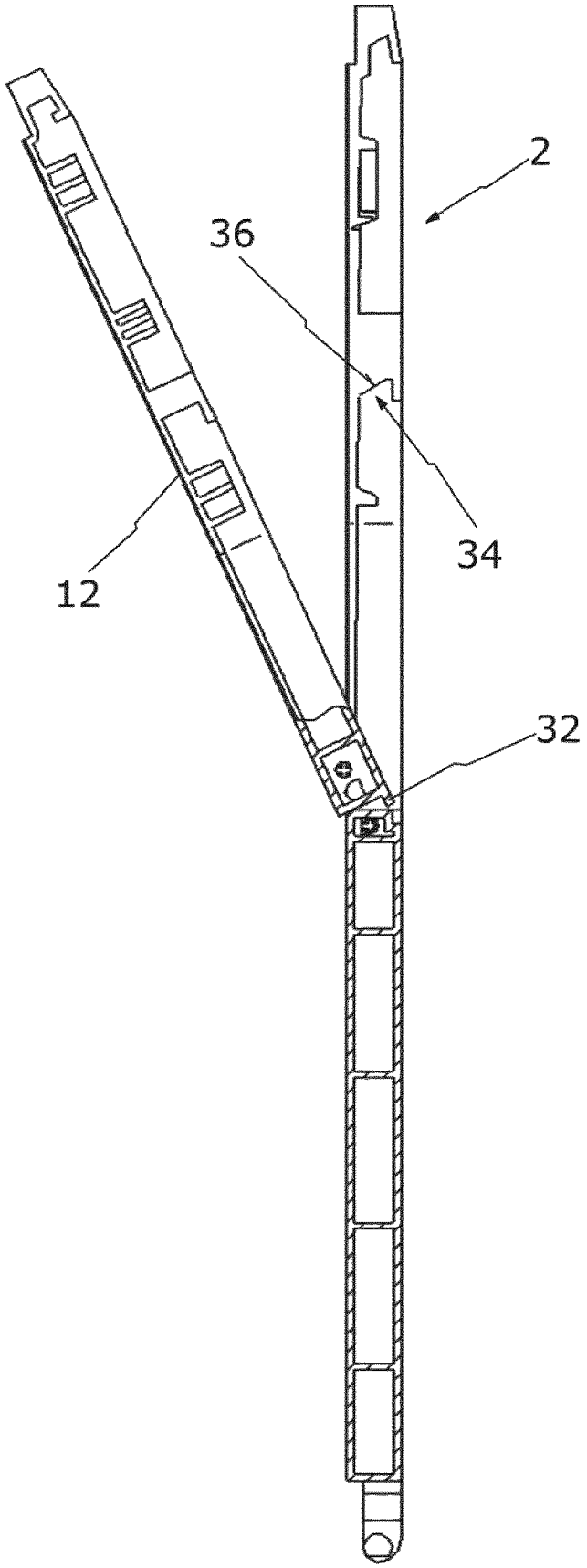

FIG. 5 shows a further intermediate position during the upward folding of the flap 12, the flap sliding in translation in the direction towards the coupling element 18 or slipping downwards as the flap 12 continues to swivel upwards, this being visible in that, in FIG. 5, the pivot bolt 20 of the flap-side joint is located in the upper region of the guide groove 28 (see also arrow indications in this drawing).

Figure 6:
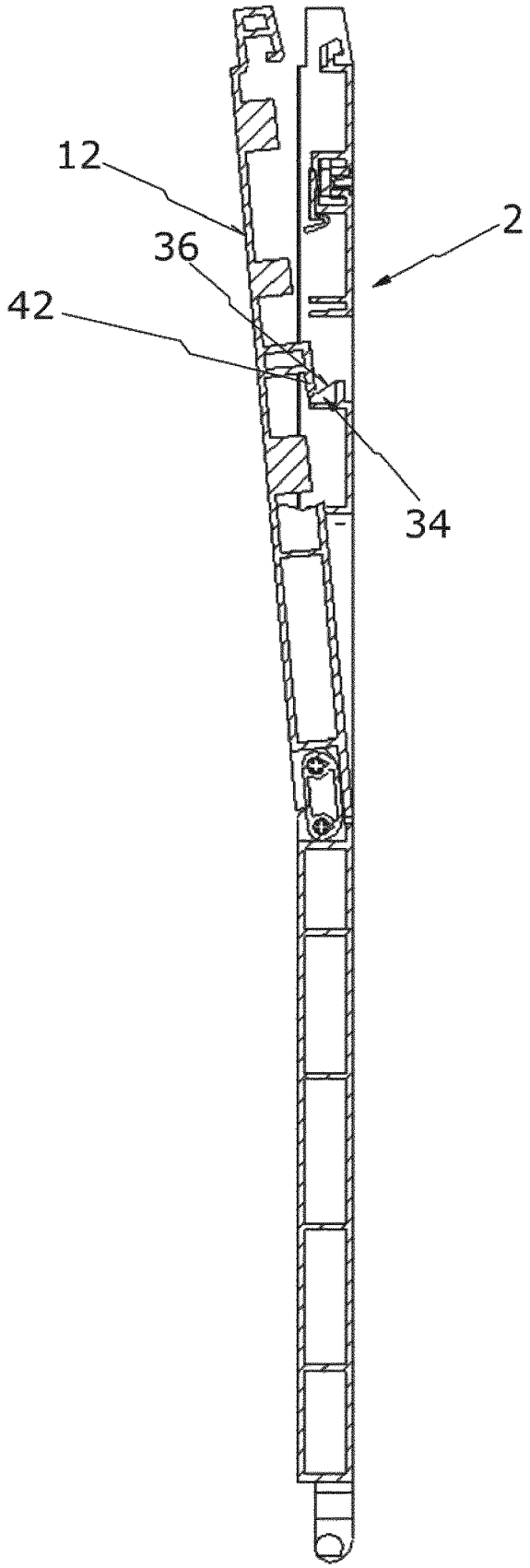

As is clear from FIG. 6, a compulsory guide for the flap 12 which, when the flap swivels, simultaneously brings about a translational flap movement in the plane of the flap, in such a way that the flap 12 is moved upwards in the direction towards the upper edge of the side wall, is highly advantageous. In the embodiment shown, a ramp 34 is provided as a compulsory guide in this context, and has an oblique wall, which extends upwards from the outer face of the side wall 2 to the inner face of the side wall 2 and is denoted as 36, as a ramp face. In the embodiment shown, in each case a ramp 34 is provided or formed on the flap opening 26 at the side on edges 38 and 40 (cf. FIG. 2).

Figure 7:
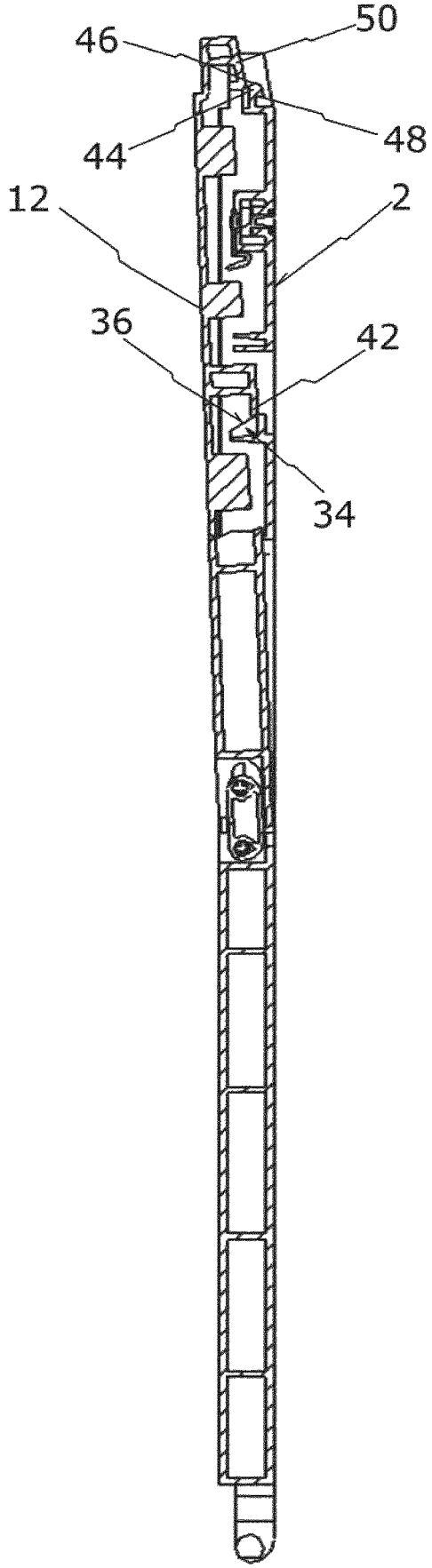

In the embodiment shown, the compulsory guide further comprises on the flap side a hooked projection 42, which is preferably directed downwards and which, as shown in FIG. 6, runs up onto the oblique face 36 of the ramp 34 in this swivelled-up position shown in FIG. 6, in which by way of example the flap is located at an angle of approximately 6° to the vertical side wall. As the flap 12 swivels further in the direction of the side wall 2, the hooked projection 42 runs on the ramp 34, in such a way that the flap 12 is lifted upwards, FIG. 7 showing a swivel position of the flap very close to the vertical position of the side wall. In this position, the hook-like projection 42 is located at the upper end of the oblique face 36 of the ramp 34. A kinematic reversal of the arrangement of the ramp and the projection is also possible.

In a further expedient configuration, although this is again not obligatory, a second compulsory guide is provided, which has a second ramp 44 with an oblique face 46, the oblique face likewise extending obliquely upwards from the outer face to the inner face. In this context, the ramp 44 is undercut on the inner face of the side wall, the undercut in the manner of a groove being illustrated with reference numeral 48. In this context, the relationships are even more clearly visible in FIG. 7 by virtue of the enlarged view, shown on the left, of the upper region of the flap 12.

Figure 9:
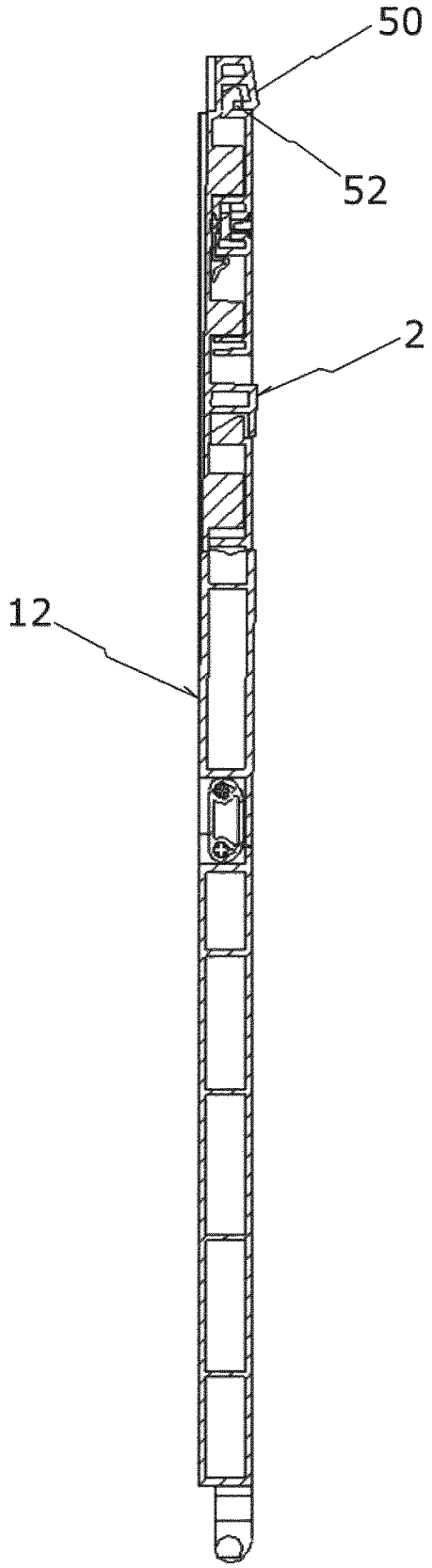

At the flap 12, the compulsory guide further has a second projection 50, which again is hooked, on the lateral flap edge, said projection, like the projection 42, being directed downwards. As is apparent from FIG. 7, in this swivel position the flap 12 of the second projection 50 runs straight onto the oblique face 46 of the second ramp 44 and, as the flap 12 continues to swivel, runs upwards on the slope, in such a way that the flap 12 is lifted further by the second oblique face 46 until the position shown in FIG. 9 is reached, in which the projection 50 of the ramp 44 has overrun and the outwardly directed nose or hook 52 of said projection engages below the oblique face of the ramp, causing the flap 12 to be locked in this closed position in which the flap 12 seals the flap opening 26. In this closed position of FIG. 9, the flap 12 has fallen downwards in translation, the first hook-shaped projection 42 also engaging behind the first ramp 34 in this position, as is also apparent from FIG. 9, and the flap 12 thus also being locked in this position. By lifting the flap 12 upwards, the flap 12 can be unlocked, in that, in the case of the embodiment with two ramps, the corresponding projections are correspondingly lifted further upwards, in such a way that it is possible for the flap 12 to pivot outwards into the position visible in FIG. 3.

Expediently, a spring bias for the flap 12 may also be provided in the closed position, as is explained purely by way of example with reference to the drawings. In the embodiment which is described in greater detail here purely by way of example, in this context a spring 54 is provided in each case on the two edges 38, 40 of the side wall which laterally delimit the flap opening 26, and said spring can expediently be clipped into the wall. Depending on the configuration of the spring 54, it can be tensioned vertically upwards when the flap 12 engages in the closed position, in such a way that a downward bias occurs. As a result, a secure locked position of the flap 12 in the side wall 2 is provided. To lift the flap 12, it is then necessary to pull the flap 12 vertically upwards against the biasing force of the spring 54, so as then to be able to swivel it.

Figure 8:
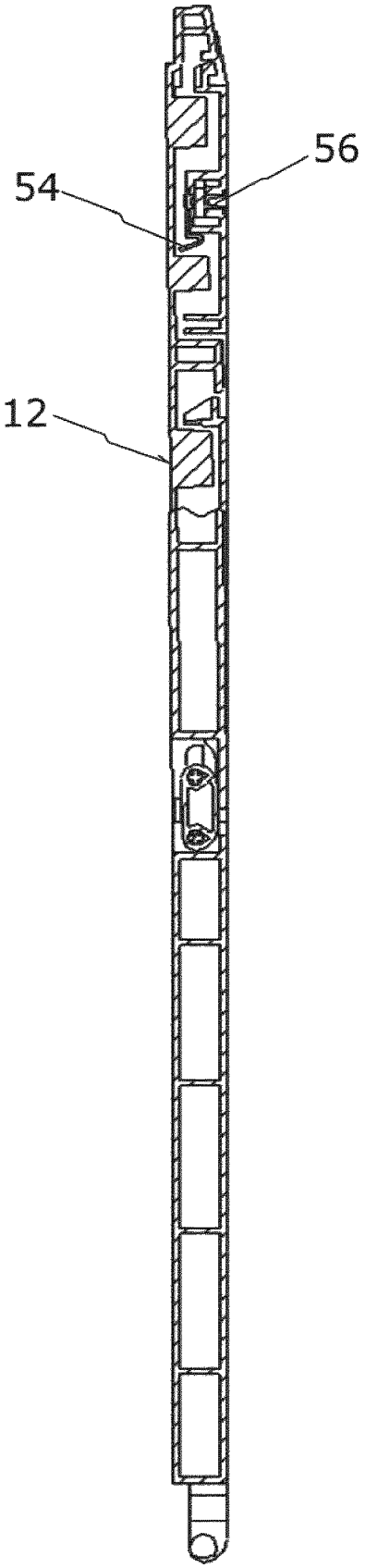

In an alternative configuration, when the flap 12 is engaged in the closed position to block the flap opening 26, the spring may also be pressed horizontally in the direction of the flap interior, with the result that, when the flap 12 is pulled upwards for unlocking, the flap is, in effect virtually automatically, transferred into the folded position, since the spring is then pressing the flap 12 into the open position. The operation and arrangement of the spring are also very clearly visible from the enlarged drawing in FIG. 8, which also shows the clip-in part 56 of the spring.

As is apparent from the above description, in principle even one ramp is sufficient to move the flap 12 upwards in translation correspondingly during the swivel movement, for which purpose the ramp may alternatively also be provided for example on the lower edge of the flap opening 26 or on the lower edge of the flap, in such a way that when the flap is closed it moves upwards as a result of the ramp effect due to an oblique face. Expediently, the ramp may also be provided on one or in particular preferably both of the lateral edges of the flap 12, the latter being the case in the described embodiment.

Particularly advantageously, two ramps arranged above one another may be provided in each case, in such a way that travelling over the first ramp results in an upwards movement and travelling over the second ramp finally results in a further upwards movement, this being advantageous, in particular in the case of narrow side walls and flap walls, for generating a corresponding lifting movement of the flap.

FIGS. 10 to 16 show a further embodiment having in principle the same mode of operation as the preceding embodiment, but with modifications which are explained in the following, the same reference numerals as in the preceding embodiment being used for the same or comparable structural elements.

Figure 13:
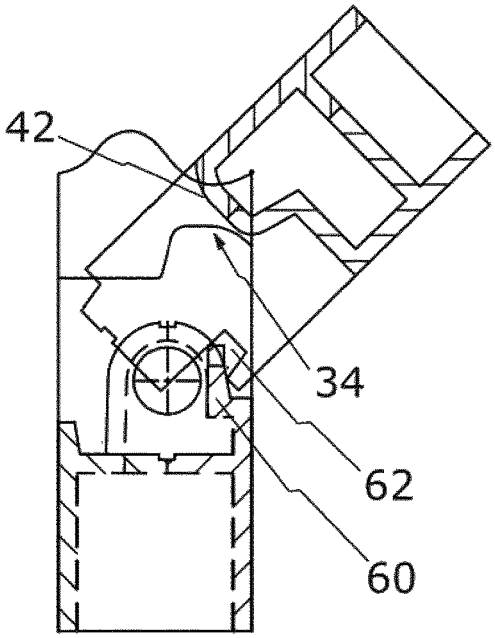
FIG. 13 shows an operating position of the flap in a flap position in the section plane of FIG. 10.
Figure 14:
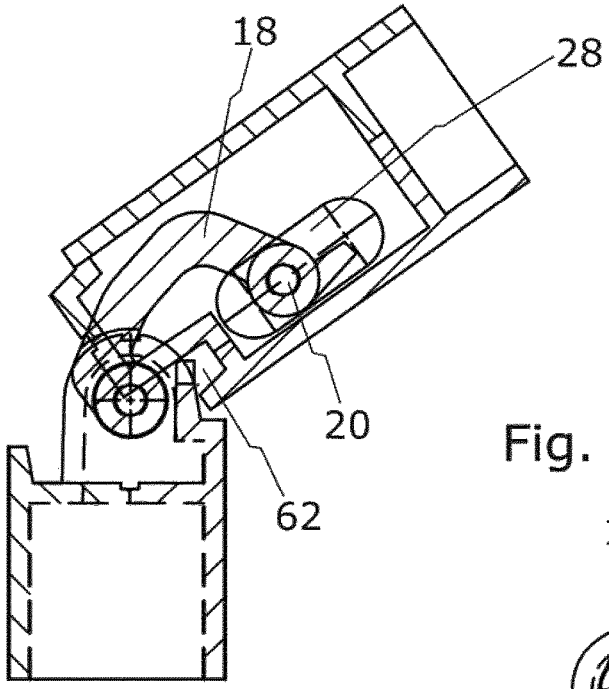
FIG. 14 is an analogous view of the operating position of FIG. 13, but in the section plane of FIG. 11.
Figure 15:
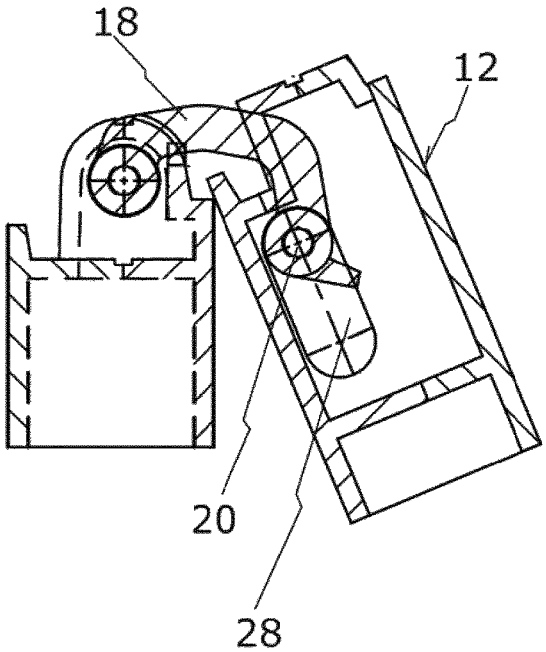
FIG. 15 shows an operating position with a flap position directed further downwards in the section plane of FIGS. 11 and 14.
Figure 16:
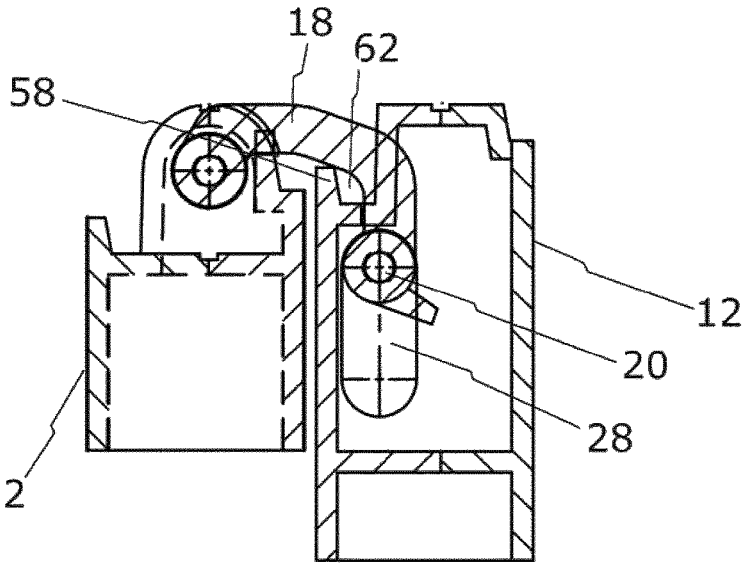
FIG. 16 is a sectional drawing of the embodiment with the flap fully folded down, again in the section plane analogous to FIG. 11.

In particular, in this example both the ramp 34 having the oblique face 36 and elements 42 for locking the flap 12 in the vertical position thereof are arranged or formed downwards in the direction of the lower flap edge 14. FIG. 11 shows the flap 12 in a section slightly offset from the section plane of FIG. 10, the flap being located in the same functional position, in other words in the vertical position in alignment with the side wall 2. Again, on the side wall of the flap 12, the guide groove 28 for the translational guidance of the flap 12 is shown, again preferably formed as a slot. FIG. 13 shows the flap in an oblique position, the projection 42 running over the ramp 34 in this position. FIG. 14 shows the same functional position as FIG. 13, but in a section plane in accordance with FIG. 11, in such a way that the guide of the flap-side pivot bolt 20 is visible in the slot 28. FIG. 15 finally shows a position of the flap 12 close to the position fully folded downwards, the pivot bolt 20 being located in the upper region of the guide 28. In the drawing of FIG. 16, the flap 16 is folded fully onto the side wall, in other words fully unfolded downwards.

Figure 10:
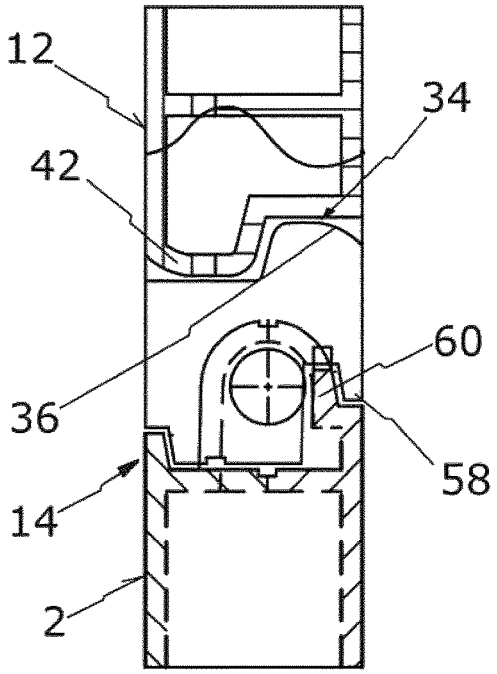
FIG. 10 is a sectional view of a further alternative embodiment, with a section plane in the region of the joint formation between the flap and the side wall.
Figure 11:
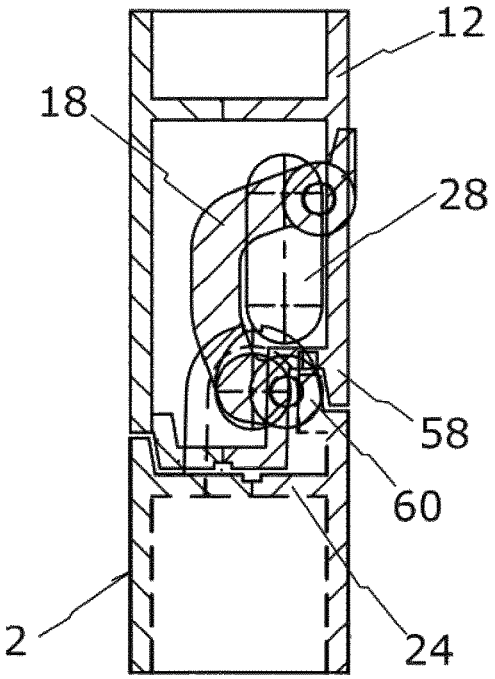
FIG. 11 is a sectional view in the same operating position as FIG. 10, but with a slightly offset section plane to show the coupling members.

From FIGS. 10 to 16, it is clear that in this embodiment the flap has, on the container outer face on the lower flap edge, a tongue-like extension 58, which, in the vertical position visible in FIGS. 10 and 11 of the flap 12, engages behind a downwardly directed wall projection 60 of the side wall. In this context, as is most clearly apparent from FIGS. 13 and 14, the tongue-like projection 58 delimits a receiving pocket 62, into which the upwardly directed wall projection, which is formed directed upwards in the region of the lower flap edge 24, engages in the position shown in FIGS. 10 and 11 of the upwardly directed wall projection 60. As is illustrated in FIGS. 10 and 11, this results locking for the positioning of the flap 12 in a vertical position, the flap 12 being moved downwards in this position.

Figure 12:
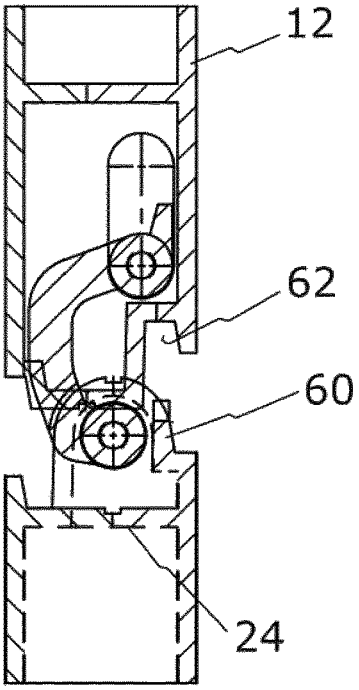
FIG. 12 shows an operating position of the flap in a raised state by comparison with FIG. 11.

For illustration, FIG. 12 shows a position before the operating position of FIGS. 10 and 11, with a position of the flap 12 where it is located upright in the vertical position and can move downwards in translation, in such a way that the receiving pocket 62 then encompasses the wall projection 60 of FIGS. 10 and 11.

FIG. 13 shows a flap position where the flap 12 can be lifted and folded outwards. As the downwards folding continues, the wall projection 60 finally moves out of the receiving pocket 62, as is most clearly apparent from FIG. 14, and the flap 12 then in effect rotates downwards around the wall projection 60, this taking place with the coupling members 18 positioned in between in the present case.

In the position of FIG. 16, the flap 12 is fully transferred into the folded-down vertical position, where in the embodiment shown it extends parallel to the outer face of the side wall. In this position, lifting of the flap 12 in the vertical direction is not possible, since this is blocked by the coupling members 18. For opening, the flap 12 first has to be swivelled upwards, until the blocking contact of FIG. 16 between the extension 58 and the coupling member 18 is finally eliminated, and finally as upwards folding continues the flap articulation is guided in the guide 28 and an upwards movement of the swivel flap 12 is thus made possible, in that the projection 42 runs onto the ramp 34 or the oblique face 36 into the position of FIG. 12, in which the flap 12 can then fall down in the direction of the lower edge of the flap opening 24 and then in this position takes on the locked position of FIGS. 10 and 11.

Figure 17:
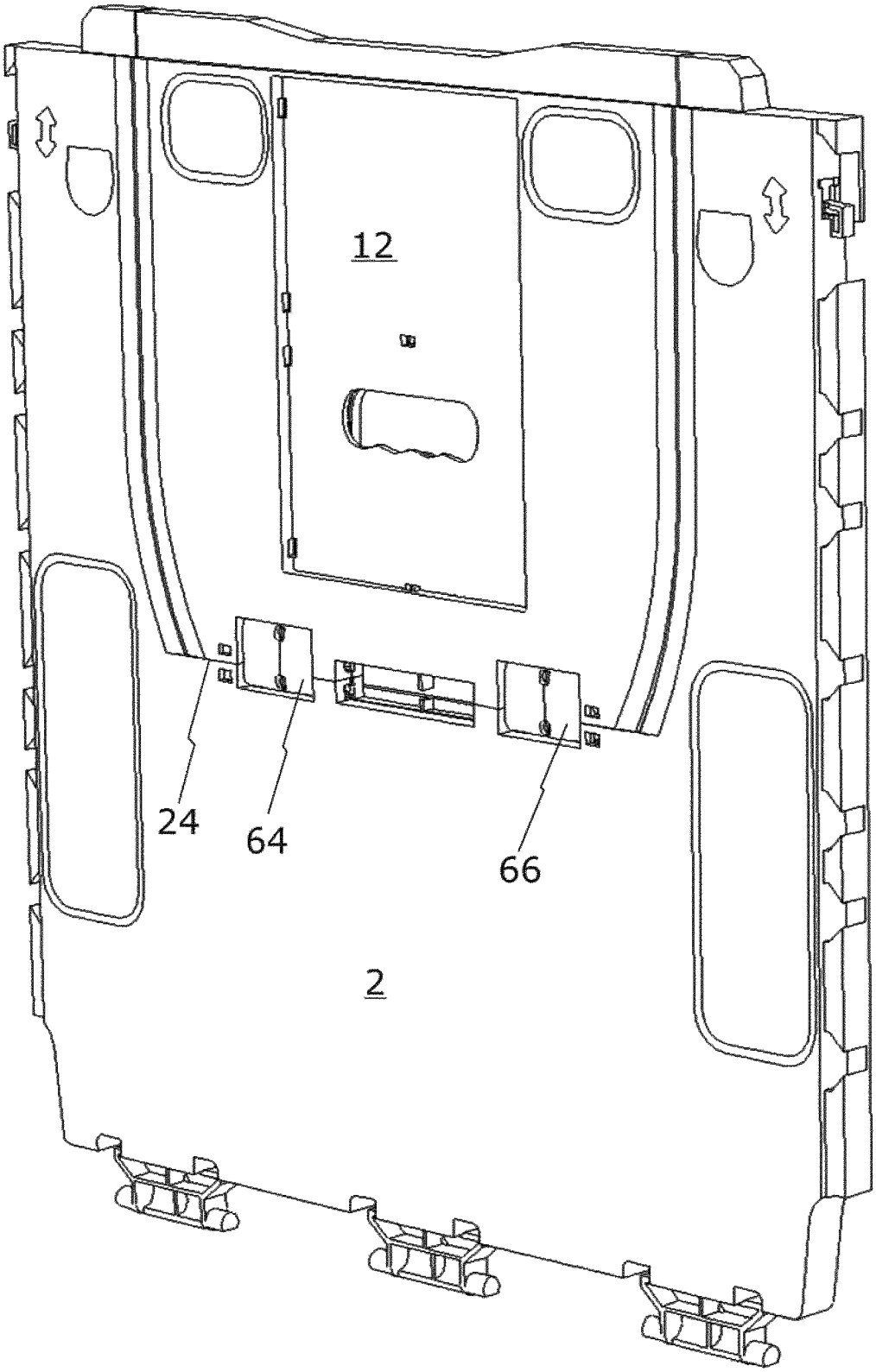
FIG. 17 shows a modified embodiment of a flap in a side wall with two flap joints.
Figure 18:
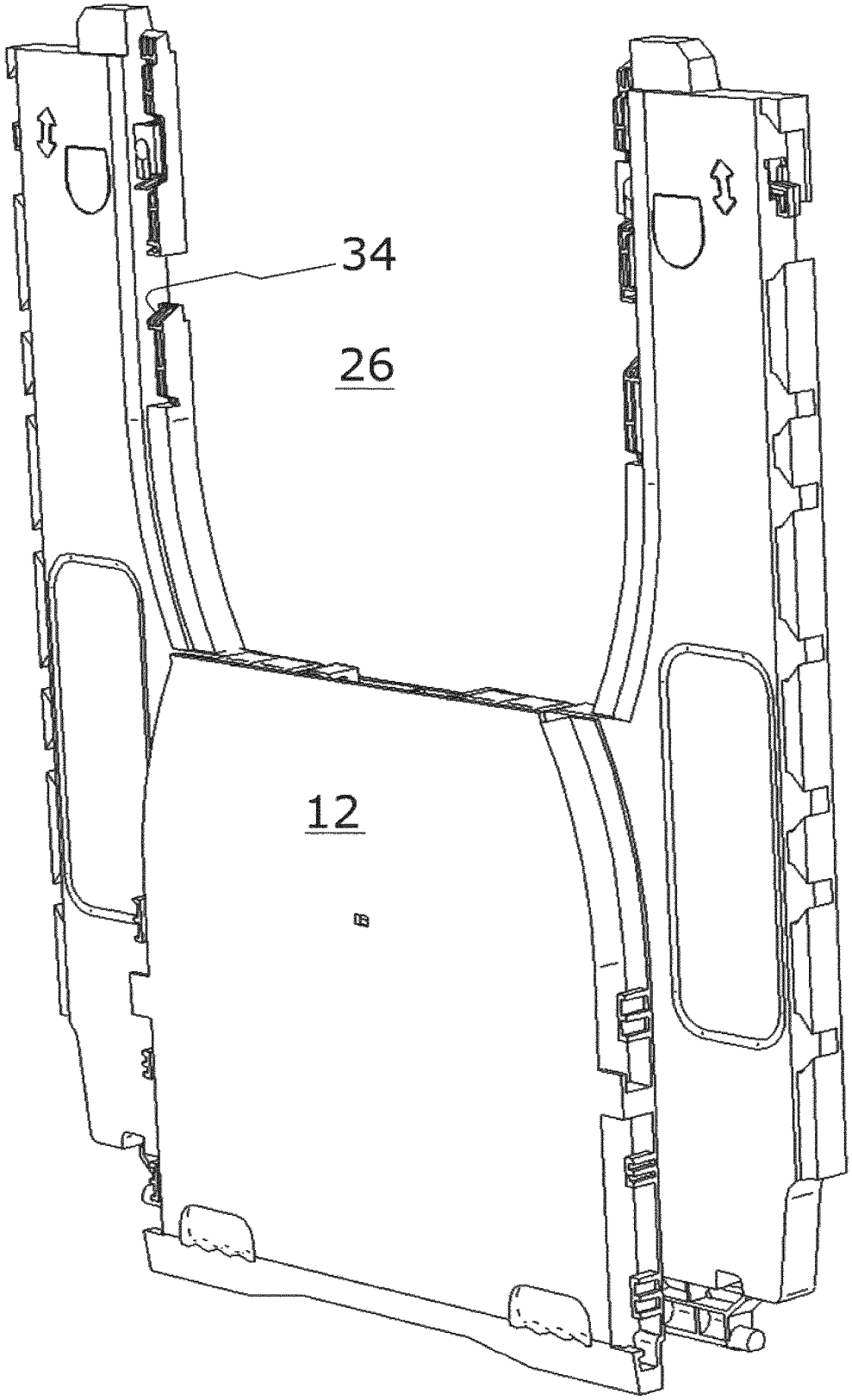
FIG. 18 is a drawing of the side wall of FIG. 17 with the flap fully folded down or in the opening position of the side wall.

FIGS. 17 and 18 show a slightly modified embodiment, in which the flap 12 is articulated to the lower edge of the flap opening via only two flap joints 64 and 66. FIG. 18 shows the flap 12 in its fully folded-down position for clearing the flap opening 26. The ramps 34 are thus also clearly visible in FIG. 18. FIG. 17 finally shows a practical embodiment of the joint arrangement of the swivelable side wall 2 by way of three joint configurations of a construction known per se on the base of the large container.

The invention claimed is:

1. A heavy load carrier, comprising:

peripherally arranged side walls, at least one of the side walls having a flap which seals a flap opening in the side wall in the closed position, and that is configured to be swivelled into an opening position in which the flap is folded against the side wall from the outside;

wherein the flap is articulated to the side wall by coupling elements, the coupling elements being articulated to the side wall by side wall joints and to the flap by flap joints, and wherein in at least one compulsory guide for the flap is configured such that during the swivelling of the flap the at least one compulsory guide simultaneously brings about a translational flap movement in a plane of the flap in such a way that the flap moves upwards in the direction of an upper edge of the side wall during the closing of the flap opening; and a spring is arranged on the lateral side edges of the side wall which delimits the flap opening, and is biased with the engaging of the flap in a closed position such that the flap is held in the locked position, wherein the spring presses against the flap when the flap is engaged in the closed position.

2. The heavy load carrier according to 1, where the at least one compulsory guide of the flap is formed by at least one leading ramp which is arranged on the side wall or the flap.

3. The heavy load carrier according to claim 1, wherein the flap, the coupling element or the side wall has at least one guide groove for the translational flap movement, which cooperates with one of the joints of the coupling elements.

4. The heavy load carrier according to claim 1, wherein the compulsory guide is arranged on two lateral edges of the flap opening and of the flap.

5. The heavy load carrier according to claim 4, wherein on the lateral edges of the flap opening a first leading ramp is provided, and wherein the first leading ramp cooperates with a hooked first projection on the two lateral flap edges, or a kinematically reversed arrangement.

6. The heavy load carrier according to claim 5, wherein on the lateral edges of the flap opening a second leading ramp is provided that cooperates with a hooked second projection on the two lateral flap edges, or a reversed arrangement.

7. The heavy load carrier according to claim 6, wherein the second leading ramp and the second projection are arranged vertically offset, in the direction of the upper edge of the side wall, above the first leading ramp and the first projection.

8. The heavy load carrier according to any claim 1, wherein at least one first ramp is formed such that after travelling of the flap over the at least one first ramp the flap moves in the translational direction of a base of the side wall under gravity and/or spring bias.

9. The heavy load carrier according to claim 8, wherein a second ramp is formed in such a way that a second projection cooperating therewith runs up onto the second ramp as soon as a first projection reaches a peak of the first ramp, and in that the flap moves downwards as soon as the second projection overruns the corresponding ramp in each case, the second ramp being formed with an undercut in the form of a groove, which a nose of the second hooked projection engages behind in each case.

10. The heavy load carrier according to claim 1, wherein first and second ramps are each formed by oblique faces which extend from an outer wall of the side wall in the direction of a side wall inner face obliquely upwards in the direction of an upper edge of the side wall.

11. The heavy load carrier according to claim 1, wherein the joints of the coupling elements are formed by pivot bolts.

12. The heavy load carrier according to claim 1, wherein the coupling elements are received in recesses on the flap edge which is lower in the closed position of the flap.

13. The heavy load carrier according to claim 12, wherein the pivot bolts of the coupling elements engage in guide grooves for the translational flap movement, which are formed in lateral faces of the recesses.

14. The heavy load carrier according to claim 1, wherein on a face of the flap which is inner in the closed position, in the region of the coupling elements, a stop tongue projects, which, when the flap swivels up, encompasses the corresponding coupling element such that overswivelling of the coupling elements is blocked by the flap when the flap is swivelling upwards.

* * * * *